United States Patent [19]

Graff et al.

[11] 4,244,985

[45] Jan. 13, 1981

[54] METHOD OF CURING THERMOSETTING PLASTIC POWDER COATINGS ON ELONGATED METALLIC MEMBERS

[75] Inventors: Hart F. Graff, Middletown; Christy Christ, Trenton, both of Ohio

[73] Assignee: Armco Inc., Middletown, Ohio

[21] Appl. No.: 679,386

[22] Filed: Apr. 22, 1976

Related U.S. Application Data

[63] Continuation-in-part of Ser. No. 576,881, May 12, 1975, abandoned.

[51] Int. Cl.[3] ..... B05D 1/06

[52] U.S. Cl. ..... 427/27; 427/46; 427/185; 427/195; 427/374.3; 427/374.4

[58] Field of Search ..... 427/27, 32, 185, 195, 427/201, 374 B, 374 C, 374 D, 379, 434, 46

[56] References Cited

U.S. PATENT DOCUMENTS

| | | | |
|---|---|---|---|
| 3,019,126 | 1/1962 | Bartholomew | 427/32 X |
| 3,248,253 | 4/1966 | Barford et al. | 427/32 X |
| 3,393,086 | 7/1968 | Keating | 427/379 X |
| 3,513,012 | 5/1970 | Point | 427/27 |
| 3,560,239 | 2/1971 | Facer et al. | 427/409 |
| 3,579,379 | 5/1971 | Van Berkel et al. | 427/379 X |
| 3,598,626 | 8/1971 | Probst et al. | 427/32 |
| 3,770,482 | 11/1973 | Millar et al. | 427/25 X |

FOREIGN PATENT DOCUMENTS

| | | | |
|---|---|---|---|
| 675205 | 12/1963 | United Kingdom | 427/374 C |

*Primary Examiner*—Shrive P. Beck

[57] ABSTRACT

The method of coating an elongated metallic member with a thermosetting plastic powder coating or with a thermosetting plastic powder undercoating and a thermoplastic powder outer coating, is significantly improved by passing the coated elongated metallic member through at least one induction coil to heat the metal and thereby the coating to the curing temperature of the thermosetting plastic powder and holding the temperature for the curing time. Curing temperatures, which depend upon the thermosetting plastic powder coating being cured, are sufficient to fully cure the material within seconds.

10 Claims, 13 Drawing Figures

METHOD OF CURING THERMOSETTING PLASTIC POWDER COATINGS ON ELONGATED METALLIC MEMBERS

CROSS REFERENCE TO RELATED APPLICATION

This application is a continuation-in-part of application Ser. No. 576,881, filed May 12, 1975, in the names of Hart F. Graff and Christy Christ, and entitled "METHOD OF CURING THERMOSETTING PLASTIC POWDER COATINGS ON ELONGATED METALLIC MEMBERS" now abandoned.

BACKGROUND OF THE INVENTION

1. Field of the Invention

This invention relates to elongated metallic members such as tubing, wire, and the like, and more particularly to the art of curing a thermosetting plastic powder coating which has been applied to the surface thereof in order to prevent corrosion.

2. Description of the Prior Art

In many instances severe corrosion of wire and tubing as a result of specialized uses presents problems, and it is, therefore, desirable to have a coated final product. From an economical standpoint, utilizing an organic polymer as a coating for tubing and/or wire, such as a thermosetting plastic powder coating, is considerably cheaper than galvanizing. However, unlike when coating material with a thermoplastic powder, where it is simply necessary to reach a given temperature to fuse the coating and no care is required to hold the melting temperature for any required length of time, thermosetting plastic coatings, which are of low molecular weight, but which on application of heat, form higher molecular weight, cross-linked chemical structures, require time at temperature to allow for polymerization or "curing" to take place. As a practical matter, extensive modifications to existing equipment are necessitated in order to implement furnaces to cure thermosetting resins while maintaining reasonable line speeds in the neighborhood of 30 feet per minute. Accordingly, the prior art has endeavored to develop a more satisfactory way to cure thermosetting plastic powder coatings and more particularly elongated metallic members having such coatings.

U.S. Pat. No. 3,560,239, in the name of W. K. Facer, et al, is exemplary of prior art curing methods. Briefly, Facer, et al teaches the use of an induction coil for heating the enlongated substrate after application of a liquid primer. This serves to dry the primer as well as provide a heated substrate as it is passed through a fluid bed of resin powder. The sensible heat in the substrate supplies the energy for melting and holding the powder particles to the substrate to form a coating. A second induction coil following the fluidized bed is used only to fuse the particles on small diameter wire where the sensible heat or "heat sink" from the heating by the first induction coil is insufficient to completely fuse or flow the particles of coating together. However, it is not possible to coat and cure a coating of thermosetting plastic particles by following the teachings of the Facer, et al patent in which the substrate is heated by induction and passed through a fluidized bed of thermosetting resin. This is so because there is not sufficient latent heat in the wire to cause the resin to polymerize because all of the available heat in the substrate is used to melt the powdered resin. The residual heat in the melted thermoset resin is insufficient to effect a cure. Increasing heat input to the wire prior to powder application will result in pick up of a heavier deposit of melted resin which remains uncured. Large quantities of energy are required in the form of heat to convert matter from one state to another. The melting of a solid in the form of a powder uses all the energy (heat) that is stored in the wire. Increasing heat content only allows more powder to be melted. As long as a phase change is occurring, solid to liquid, little energy in the form of heat is available to cure the liquified thermosetting resin.

The prior art of induction heating emphasizes efficiency which, in turn, relates to a coil design to maximize the heating rate. An induction coil so designed is unsatisfactory for effecting a cure of a coating of thermosetting plastic due to an inability to control heat input. Degradation of the coating by over curing or loss of adherence by under curing result.

SUMMARY OF THE INVENTION

According to the present invention the method of curing a thermosetting plastic powder coating on an elongated metallic member, or a thermosetting plastic powder undercoating and a thermoplastic powder outer coating on an elongated metallic member, is significantly improved by passing the powder coated elongated metallic member through at least one induction coil to heat the metal and thereby the coating or coatings to the curing temperature of the thermosetting plastic powder and to the melting point of the thermoplastic powder. The temperature, which depends upon the thermosetting plastic powder coating being cured, cures the thermosetting plastic coating and reflows the thermoplastic coating within seconds.

The induction coil has an effective length to diameter ratio of about at least 9. However, in a preferred embodiment the induction coil comprises a series of coils in tandem to permit the rapid heating of the coated elongated metallic member in each coil and cooling between coils to prevent overheating.

BRIEF DESCRIPTION OF THE DRAWINGS

FIG. 1A is an exemplary schematic view showing the application and curing of thermosetting plastic powder coating on tubing and/or wire. FIG. 1B is an exemplary schematic view showing the application and curing of a thermosetting plastic powder undercoating and a thermoplastic powder outercoating on tubing and/or wire wherein the coatings are applied by electrostatic fluidized beds in tandem.

FIGS. 4A, 4B, 4C, 4D and 4G show exemplary induction coil configurations for the induction coil of FIGS. 1A and 1B.

FIGS. 4E and 4F show induction coil configurations not satisfactory for curing thermosetting plastic powders.

DESCRIPTION OF THE PREFERRED EMBODIMENTS

Figures 1A, 1B, 4A:
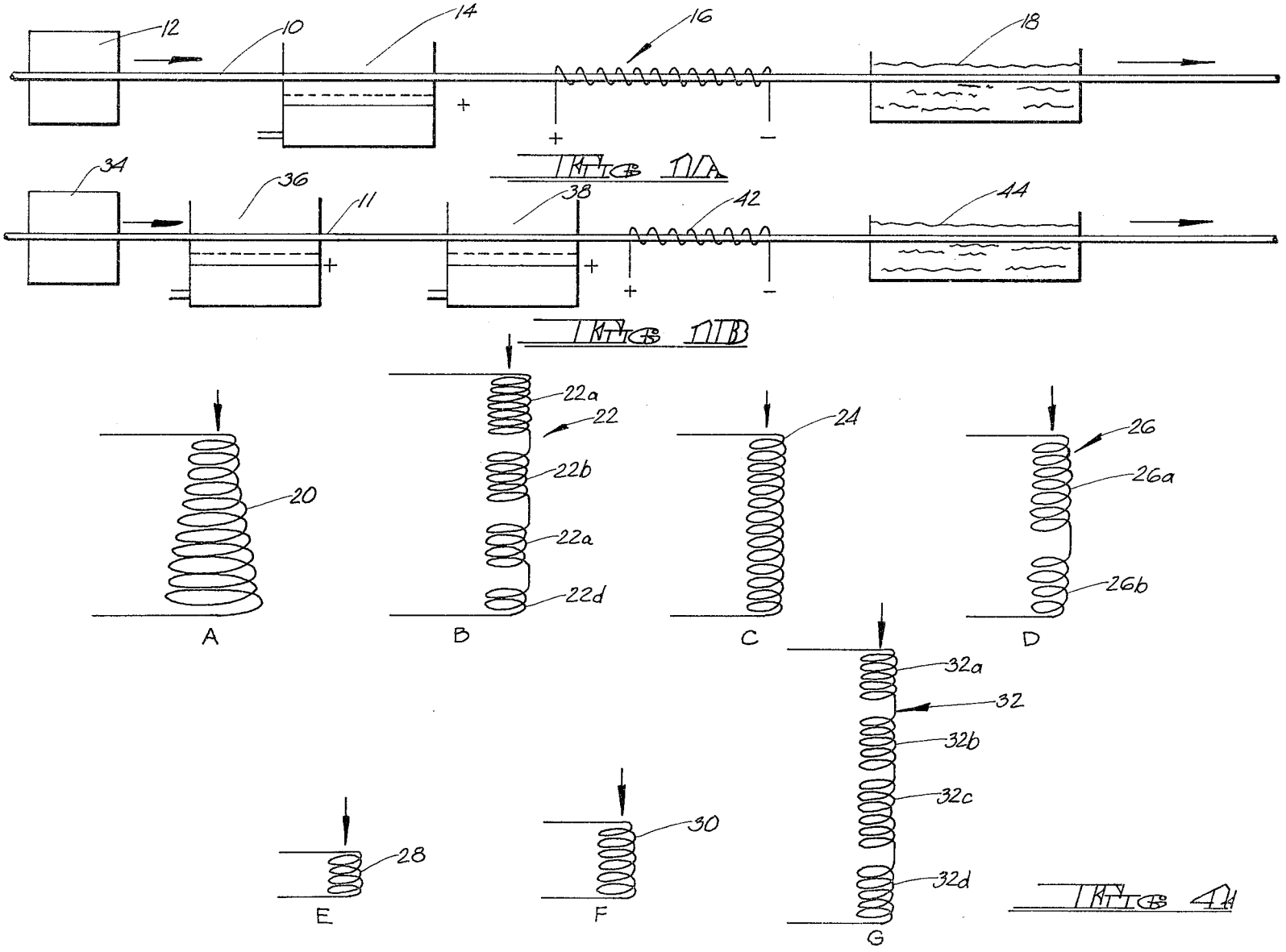

With reference to the drawings, FIG. 1A discloses an exemplary schematic view showing the application and curing of a thermosetting plastic powder coating on tubing and/or wire 10. The tubing or wire 10 to be coated may be any elongated metallic member the surface of which it is desired to protect in order to prevent corrosion. Exemplary of such an elongated metallic member is coated tubing for use primarily in automobile brake lines where corrosion of the tubing has presented substantial problems.

The first step in the process of coating an elongated metallic member 10 with a thermosetting plastic powder coating according to the present invention requires cleaning the surface of the elongated member, as shown at 12 in FIG. 1A. This step may be accomplished in any well known conventional manner.

After the surface of the elongated metallic member 10 has been cleaned, it is coated without prior heating with a thermosetting plastic powder having a specific curing time and curing temperature, as indicated at 14. The thickness of the final cured plastic coating is limited by the electrostatic attraction of the powder particles to the tubing surface, which is a function of the amount of voltage applied to the electrostatic grid and thus, the amount of charge on a powder particle. Once the surface is covered with a thickness of the powder, the intensity of the charge is insulated by the powder and fewer particles are attracted to the surface. In practice, the cured plastic coating is generally up to 190 micrometers in thickness, but in many preferred embodiments very thin films of about 75 micrometers or less are desired. It is understood that the plastic powder can be applied; by an electrostatic fluidized bed, or by electrostatic powder spray gun.

After the elongated metallic member 10 is cleaned and coated with thermosetting plastic powder, the powder must be cured. Thermosetting powder coatings are of low molecular weight but form higher molecular weight chemical structures by cross linking upon application of heat. This involves a gel formation which is not instantaneous. Accordingly, the curing of thermosetting plastics is time-temperature dependent because of the time required for the cross-linking or gel formation to take place. The time can be decreased by the addition of a catalyst, but the properties of the cured coating are degraded as the catalyst content is increased.

According to the present invention, the thermosetting plastic powder is cured by passing the coated elongated metallic member through at least one induction coil, as indicated at 16, to rapidly heat the member 10 and thereby the coating to the curing temperature, and holding the temperature for the curing time. Following curing, the coated elongated metallic member 10 is cooled, as at 18, by any conventional method, such as water quench or by forced convection.

FIG. 1B discloses an exemplary schematic view showing the application and curing and reflowing of thermosetting plastic powder and thermoplastic powder coatings, respectively, on tubing and/or wire 11. This combines the toughness, adherence and abrasion resistance of thermosetting plastic coatings, such as epoxies, with the cosmetic gloss retention and ultraviolet light resistance of thermoplastic coatings, such as vinyls.

The first step in the process shown in FIG. 1B requires cleaning the surface of the elongated member, as shown at 34. This step may be accomplished in any well known conventional manner.

After the surface of the elongated metallic member 11 has been cleaned, it is coated without prior heating with a thermosetting plastic powder undercoating having a specific curing time and curing temperature, as indicated at 36. In practice the cured thermosetting plastic coating is generally in the range of 25 to 75 micrometers in thickness, with 25 micrometers being preferred. The member 11 is then coated with a thermoplastic powder undercoating, as indicated at 38. In practice the reflowed thermoplastic powder coating is generally in the range of 75 to 650 micrometers thickness, with 175 micrometers being preferred.

There are, of course, several ways the aforementioned duplex coating may be applied. As indicated in FIG. 1B, two or more electrostatic fluidized beds 36 and 38, in tandem, may be provided. In still a further method of application, the thermosetting plastic powder and the thermoplastic powder may be combined and applied simultaneously by electrostatic spray gun as taught in U.S. Pat. No. 3,770,482, in the name of John M. Miller, et al, and in U.S. Pat. No. 3,513,012, in the name of Marcel A. R. Point, and the composite coating may them be cured by the induction coil 42. However, it will, of course, be necessary for the powder particles of each component to differ in Dielectric constant for preferential attraction to the member 11, and preferably one of the powders is highly conductive.

According to the present invention, the thermosetting plastic powder undercoating and the thermoplastic powder outercoating on the member 11 are cured (thermosetting plastic powder) and reflowed (thermoplastic powder coating) by passing the duplex coated elongated metallic member 11 through at least one induction coil, as indicated at 42, to rapidly heat the member 11 and thereby the coatings to the curing temperature of the thermosetting plastic powder, and hold the temperature for the curing time. Following curing, the duplex coated elongated metallic member 11 is cooled, as at 44, by any conventional method, such as water quench or by forced convection. The use of induction cure permits application and thermal treatment of thick thermoplastic powder coatings. For example, an oven cure of a 25 micrometer epoxy and 175 micrometer vinyl coating results in sags and runs of the vinyl coating, since time/-temperature in the oven to cure the epoxy is excessive for simple melting/reflowing of vinyl powder.

Figure 2:
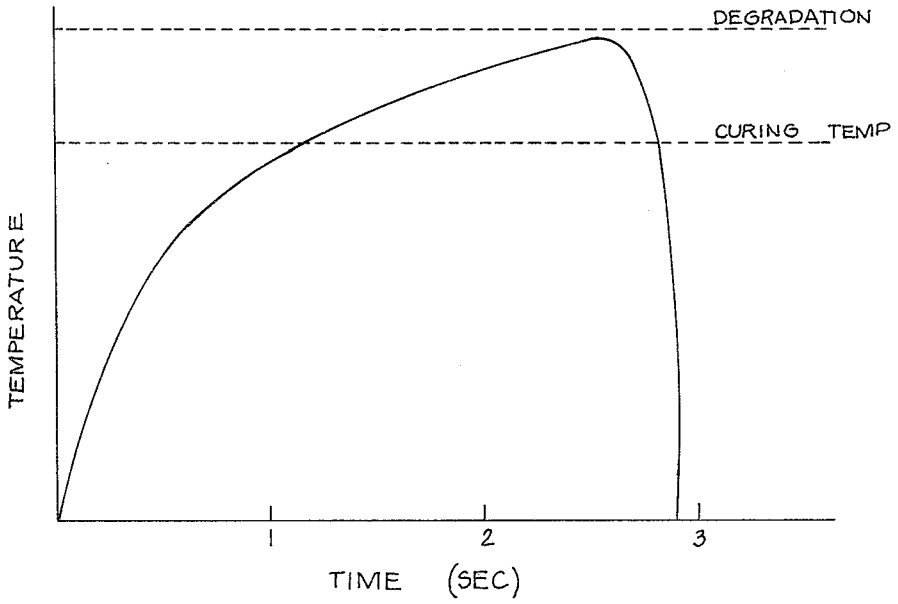
FIG. 2 is a graphical representation showing a heating curve for the curing of thermosetting plastic powder coatings according to the present invention using one induction coil.
Figure 3:
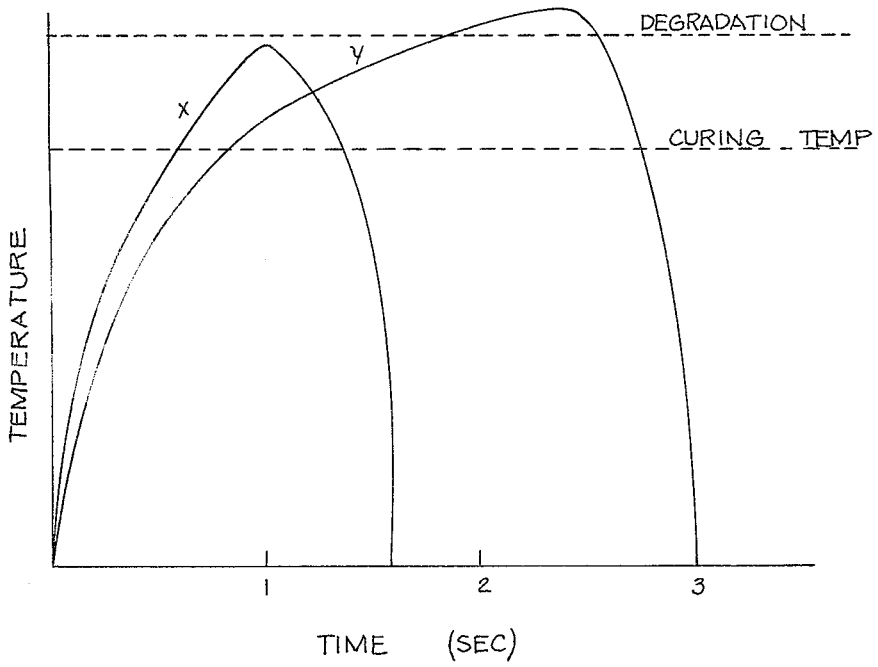
FIG. 3 is a graphical representation showing heating curves for one induction coil not within the scope of the present invention.

Since the curing of thermosetting powder coatings is time-temperature dependent, it is necessary to not only reach the curing temperature, but to also have a holding time of such duration as to allow cross-linkage of the molecular chains to be completed. This may best be seen by reference to FIGS. 2 and 3, which disclose typical heating curves. As can be seen from FIG. 2, the desired result may be achieved according to the teachings of the present invention by using only one induction coil. However, as seen from FIG. 3, and as will be more fully explained hereinafter, the curing temperature can best be maintained during the holding period by using induction coils in tandem. For example, when multi-state heating and cooling is not present, the thermosetting plastic coating may become too hot before curing is complete (curve y), or to prevent overheating, the holding time may be too short (curve x). Accordingly, even though most coil designs may probably be satisfactory, the necessary holding time dictates a coil design that may readily heat the thermosetting powder coating above the curing temperature for that material and then hold the temperature below the degradation temperature until curing is complete.

The design of the induction coil or coils 16 and 42 is a function of a number of parameters. However, the diameter of the coil or coils must provide adequate clearance so that the elongated metallic member to be cured may pass through without touching the windings. The important aspect is to induce a maximum secondary current into the material, not the frequency. The number of induction coil wraps (wraps/length) is important to maximize secondary current. However, this happens to be a function of the kilovolt (KV) rating of the generating source. The higher the KV output the less number of wraps per length are necessary. The parameters are achieved through empirical trials. Given a voltage source, the right number of series of coils and number of coil wraps per length for that given voltage source unit may be ascertained.

FIGS. 4A through 4G disclose exemplary induction coils, five of which have proven successful in their ability to cure the thermosetting plastic powder coating on the elongated metallic member 10, as well as to cure (thermosetting plastic powder) and reflow (thermoplastic powder) the duplex coated elongated metallic member 11, and to be sensitive to minor variations in line speed, coating thickness and power input to the coil. It has been determined that a long coil with a number of wraps is preferred for the induction coil 16, 42. For example, the preferred coil should have an effective length to diameter ratio of about 9.

In FIG. 4A, the induction coil 20 is of a length of 16½ inches (420 millimeters) and includes 44 wraps which vary in diameter from 1 inch to 4 inches (25 to 100 millimeters). The induction coil 22 of FIG. 4B comprises four groups of wraps, *22a*, *22b*, *22c*, and *22d*, of 8, 6, 4 and 2 wraps 1 inch (25 millimeters) in diameter, respectively, with 5 inches (125 millimeters) between each group of wraps. The overall length of the coil 22 is 24 inches (600 millimeters).

As can be seen, the induction coil 24 of FIG. 4C is 17 inches (430 millimeters) in length and includes 51 wraps 1 inch (25 millimeters) in diameter. The induction coil 26 of FIG. 4D is 14 inches (350 millimeters) in length and includes two groups of wraps *26a* and *26b* of 8 and 6 wraps 1 inch (25 millimeters) in diameter, respectively.

In FIGS. 4E and 4F induction coils 28 and 30 are shown comprising 4 and 8 wraps of 1 inch (25 millimeters) diameter and an overall length of 4 inches (100 millimeters) and 8 inches (200 millimeters), respectively. These coils were unsuccessful. Coil E did not bring the coating to cure temperature while coil F burned the coating. Finally, FIG. 4G discloses an induction coil 32 comprising 4 groups of wraps, *32a*, *32b*, and *32d* of 5, 5, 6 and 6 wraps 1 inch (25 millimeters) in diameter, respectively, with 5 inches (125 millimeters) between each group of wraps. The overall length of the coil 32 is 24 inches (600 millimeters).

The following table summarizes the power input or rheostat setting of a 30 KW 500 KC induction unit for the induction coil configurations as shown in FIGS. 4A through 4G when the line speed of the elongated metallic member 10 coated with the thermosetting plastic powder to be cured was 30 feet per minute (0.15 meters per second).

| | Power Input Setting With 30 FPM (0.15 Meters per Second) Line Speed | | | |
|---|---|---|---|---|
| Coil | Rheostat Setting | Number of Wraps | Effective Length English | SI |
| 4A, | 9.5 | 44 | 16½" | 420 millimeters |
| 4B, | 12.5 | 20 | 8½" | 215 millimeters |
| 4C, | 10 | 51 | 17" | 430 millimeters |
| 4D, | 14 | 14 | 6½" | 165 millimeters |
| 4E, | 70 | 4 | 1" | 25 millimeters |
| 4F, | 42 | 8 | 4" | 100 millimeters |
| 4G, | 11.5 | 22 | 10" | 250 millimeters |

Figure 5:
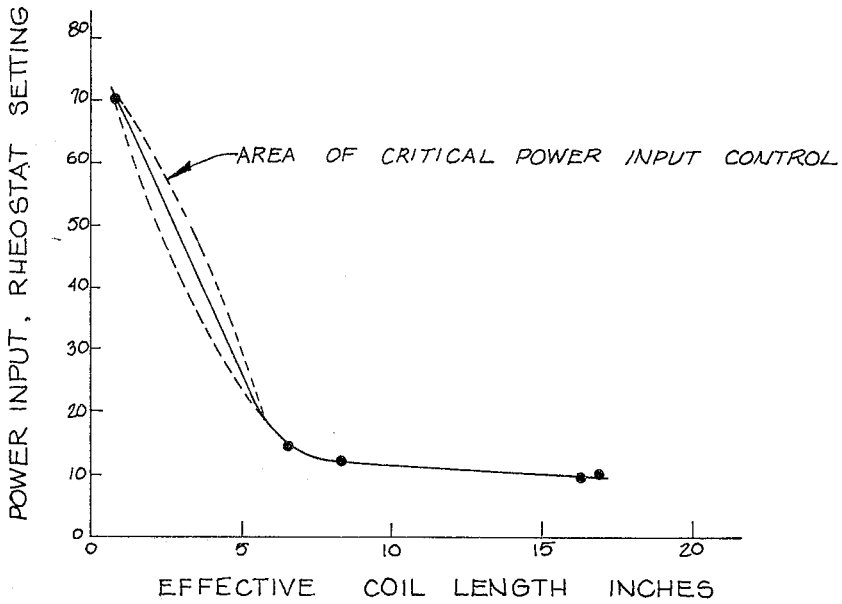
FIGS. 5 and 6 are graphical representations showing the effect of induction coil design, such as effective coil length and the number of wraps in the coil, on the power setting required for induction curing at a representative line speed of 30 feet per minute (0.15 meters per second).
Figure 6:
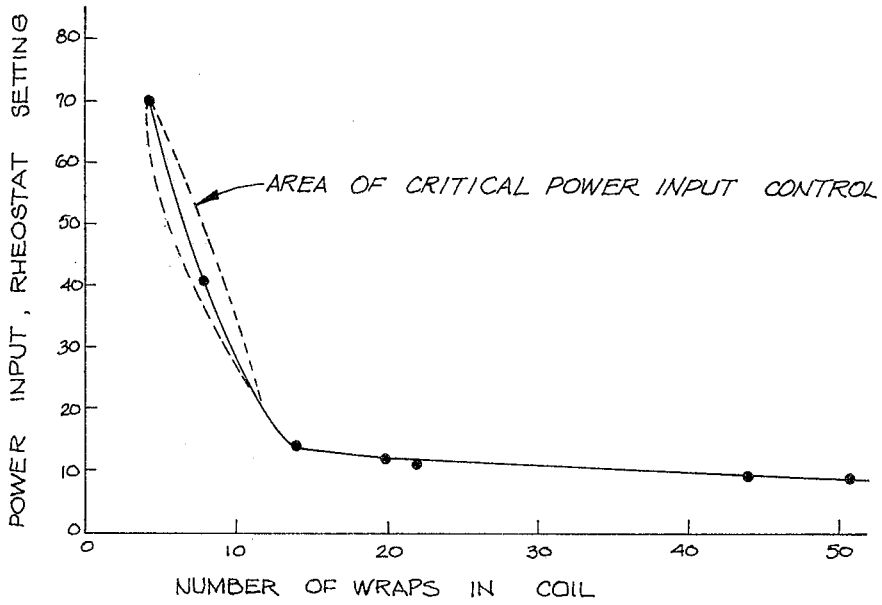

FIGS. 5 and 6 clearly indicate the effect of the induction coil configuration on the rheostat power setting as a requirement for induction curing of the thermosetting powder coating at a line speed of 30 feet per minute (0.15 meters per second). In FIG. 5, the power input, rheostat setting is plotted against the effective coil length, while in FIG. 6, the power input, rheostat setting is plotted against the number of wraps in the coil. As previously indicated, it will be seen that a long coil with a number of wraps is preferred for the induction coil 16, 42 and generally such a coil should have a heat length of at least 25 centimeters or an effective length to diameter ratio of at least about 9.

It has been determined that the thermosetting powder coating reaches a maximum temperature at the exit from the induction coil 16, 42 and that the minimum temperature for equivalent cure of the thermosetting powder coating will depend upon the thermosetting plastic powder coating being cured.

The residence time of the elongated metallic member 10 in the induction coil 16, 42 will, of course, vary depending upon the line speed and the length of the induction coil 16, 42. For example, at 30 feet per minute (0.15 meters per second), a residence time of approximately 2.3 seconds in a 14 inch (350 millimeters) long coil was found preferable for proper curing of the thermosetting powder coating. It has also been determined with respect to the induction coils 22, 26 and 32, of FIGS. 4B, 4D and 4G, wherein the induction coil comprises a series of coils or wraps in tandem, that rapid heating of the elongated metallic member 10 in each coil or wrap and cooling between coils or wraps to prevent overheating is very beneficial because the curing temperature can best be maintained during the holding period.

The following table summarizes a number of specific examples of coating an elongated metallic member with specific thermosetting plastic powder coatings and curing the coatings in accordance with the method of the present invention. Furthermore, the column entitled "Oven Cure Specification" indicates the recommended prior art curing times for the thermosetting plastic powder coatings. This column may be readily compared to the column entitled "Total Time In Coil", which indicates the curing time for the thermosetting plastic powder coating according to the present method.

| Powder Designation | Oven Cure Specification | Speed fpm | Speed mps | Power Input to Coil; Rheostat Setting | Total Time In Coil* Sec. | Temperature °F. Before Last Coil °F. | Before Last Coil °C. | After Last Coil °F. | After Last Coil °C. |
|---|---|---|---|---|---|---|---|---|---|
| Epoxy - 3M #1005 | 2 Min. at 450° F. | 30 | 0.15 | 12.5 | 4 | 325 | 163 | 475 | 246 |
| | (232° C.) | 48 | 0.25 | 14.5 | 2.5 | | | 475 | 246 |
| | | 8.9 | 0.045 | 8 | 13.5 | | | 470 | 243 |
| Polyester - 3M #3103 | 20 Min. at 400° F. | 12 | 0.060 | 7.5 | 10 | 350 | 177 | 450 | 232 |
| | (204° C.) | 10 | 0.050 | 7.5 | 13.5 | | | 425 | 218 |
| Acrylic-Celanese JK701-3 | 4 Min. at 400° F. (204° C.) | 30 | 0.15 | 10 | 4 | 300 | 149 | 350 | 177 |

*One-half of time shown is between coils or "non-heating" time.

It should, perhaps, be noted that the reason oven curing temperatures for thermosetting plastic powder coatings are so long is because the coating acts as an insulator to itself and air is a poor heat transfer media. In contrast, when using induction heating of the elongated metallic member according to the present invention, the insulating effect does not occur and the metallic member is a good means for heat transfer.

It will be understood that in the conversion from the English Units to the SI system herein, rounding off the SI Units were made to practical, realistic numbers; and there is no intention to change the meaning or relationship of the numbers.

As many possible embodiments may be made of the invention without departing from the scope thereof, it is to be understood that all matter herein set forth or shown in the accompanying drawings is to be interpreted as illustrative and not in a limiting sense.

I claim:

1. A method of coating an elongated metallic member with a thermosetting plastic powder coating comprising the steps:

(a) cleaning the surface of said elongated member;

(b) applying to the surface of said elongated member a coating of thermosetting plastic powder having a specific curing time and curing temperature;

(c) passing said coated elongated metallic member through an induction coil to rapidly heat said member and thereby said coating above said curing temperature sufficient to reduce curing time significantly, said induction coil having an effective length to diameter ratio of at least 9 and an effective length of at least 250 millimeters, and (d) cooling said coated elongated metallic member.

2. The method according to claim 1, wherein said induction coil comprises a series of turns in tandem to permit the rapid heating of said coated elongated metallic member in each turn and cooling between turns to prevent over heating.

3. The method according to claim 1, wherein said coating of thermosetting plastic powder is applied by an electrostatic fluidized bed.

4. The method according to claim 1, wherein said coating of thermosetting plastic powder is applied by an electrostatic powder spray gun.

5. The method according to claim 1, wherein said coated elongated metallic member is cooled by water quench.

6. The method according to claim 1, wherein said coated elongated metallic member is cooled by forced convection.

7. A method of coating an elongated metallic member with a thermosetting plastic powder undercoating and a thermoplastic powder outercoating comprising the steps:

(a) cleaning the surface of said elongated member;

(b) applying to the surface of said elongated member coatings of thermosetting plastic powder and thermoplastic powder, said coating of thermosetting plastic powder having a specific curing time and curing temperature and said coating of thermoplastic powder having a specific melting point;

(c) passing said coated elongated metallic member through an induction coil to rapidly heat said member and thereby said coating above said curing temperature and said melting point sufficient to reduce curing time significantly said induction coil having an effective length to diameter ratio of at least 9 and an effective length of at least 250 millimeters, and (d) cooling said elongated metallic member.

8. The method according to claim 7, wherein said inducation coil comprises a series of turns in tandem to permit the rapid heating of said coated elongated metallic member in each turn and cooling between turns to prevent over heating.

9. The method according to claim 7, wherein said thermosetting plastic powder and said thermoplastic powder are combined and applied simultaneously, said powders differing in dielectric constant for preferential attraction to said member and one of said powders being highly conductive.

10. The method according to claim 7, wherein said thermosetting plastic powder coating and said thermoplastic powder coating are each applied separately by electrostatic fluidized beds.

* * * * *